United States Patent [19]

Bohler

[11] Patent Number: 4,672,880

[45] Date of Patent: Jun. 16, 1987

[54] FIRING APPARATUS FOR AN EXTERNALLY POWERED FIRING WEAPON

[75] Inventor: Erwin Bohler, Zurich, Switzerland

[73] Assignee: Werkzeugmaschinenfabrik Oerlikon-Bürhle, Zurich, Switzerland

[21] Appl. No.: 800,202

[22] Filed: Nov. 21, 1985

[30] Foreign Application Priority Data

Dec. 10, 1984 [CH] Switzerland ..... 5845/84

[51] Int. Cl.[4] ..... F41F 11/00

[52] U.S. Cl. ..... 89/12; 89/11

[58] Field of Search ..... 89/12, 9, 11, 13.05, 89/185, 182, 183

[56] References Cited

U.S. PATENT DOCUMENTS 4,550,641 11/1985 Bruderer et al. ..... 89/11

*Primary Examiner*—Frederick R. Schmidt
*Assistant Examiner*—Robert A. Rose
*Attorney, Agent, or Firm*—W. W. Kleeman

[57] ABSTRACT

In a Gatling gun containing a rotary weapon barrel assembly and positively reciprocating breechblocks, each of which is operatively associated with one weapon barrel of the weapon barrel assembly, each breechblock is provided with a spring-loaded firing pin and a cocking pin which are cocked and released by two control cams for piercing a cartridge. These two control cams are displaced from a safety or unarmed position into a firing position by a control slide possessing oppositely extending control grooves or slots. This firing apparatus possesses no pivotable parts as opposed to known apparatuses.

3 Claims, 6 Drawing Figures

FIRING APPARATUS FOR AN EXTERNALLY POWERED FIRING WEAPON

CROSS-REFERENCE TO RELATED PATENT

The present application is related to the commonly assigned U.S. Pat. No. 4,550,641, granted Nov. 5, 1985, and the disclosure of which patent is incorporated into the present application by reference.

BACKGROUND OF THE INVENTION

The present invention broadly relates to a new and improved construction of a firing apparatus for firing a cartridge in an externally powered firing weapon.

In its more particular aspects, the present invention relates to a new and improved construction of a firing apparatus for firing a cartridge in an externally powered firing weapon comprising at least one rotary weapon barrel and a positively reciprocatable breechblock. A spring-loaded firing pin is displaceably mounted in this breechblock. Furthermore, the firing weapon is provided with two displaceable control cams for cocking and releasing the firing pin for piercing or penetrating a cartridge.

In a firing weapon of this type, as known, for example, from German Patent Publication No. 3,202,840, published Aug. 26, 1982, a rotor containing a plural number of weapon barrels is rotatably mounted in a housing. A breechblock is displaceably arranged in the rotor and possesses an impact bolt with a cocking pin. Furthermore, there is fixed at the housing a firing and unarming or safety control cam apparatus. This apparatus contains a first cam surface which, at the start, engages or holds the cocking pin when the rotor is rotating in clockwise direction, and a second cam surface which, at the start, engages or holds the cocking pin when the rotor is rotating in counter-clockwise direction. These two cam surfaces, conjointly with a third cam surface, render possible:

(a) an initial descent of the cocking pin from the first cam surface and a subsequent increasing ascent from the descended position to the second cam surface in the clockwise direction, (b) an initial descent of the cocking pin from the second cam surface and a subsequent increasing ascent from the descended position to the first cam surface in counter-clockwise direction, and (c) the formation of a continuous portion or component between the first and second cam surfaces.

The known firing and safety or unarming apparatus must operate when the rotor is rotating in the clockwise direction as well as when the rotor is rotating in the counter-clockwise direction. This results in a relatively complicated construction.

SUMMARY OF THE INVENTION

Therefore, with the foregoing in mind, it is a primary object of the present invention to provide a new and improved construction of a firing apparatus for firing a cartridge in an externally powered firing weapon and which does not exhibit the aforementioned drawbacks and shortcomings of the prior art construction.

Another important object of the present invention is directed to the provision of a new and improved construction of a firing apparatus for firing a cartridge in an externally powered firing weapon and which has the simplest possible construction and yet operates in the most reliable manner possible.

Now in order to implement these and still further objects of the invention, which will become more readily apparent as the description proceeds, the firing apparatus of the present development is manifested by the features that, a control slide provided with oppositely extending control grooves or slots is displaceably arranged for displacing the two control cams out of an unarmed or safety position into a firing position.

It is preferable if the control slide is displaceable into its firing position against the force of a spring by means of a hydraulic piston and if its control grooves or slots possess a central oblique section and related straight sections at its ends. The two central oblique sections of the two control grooves or slots are arranged to extend in opposing directions with respect to each other.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
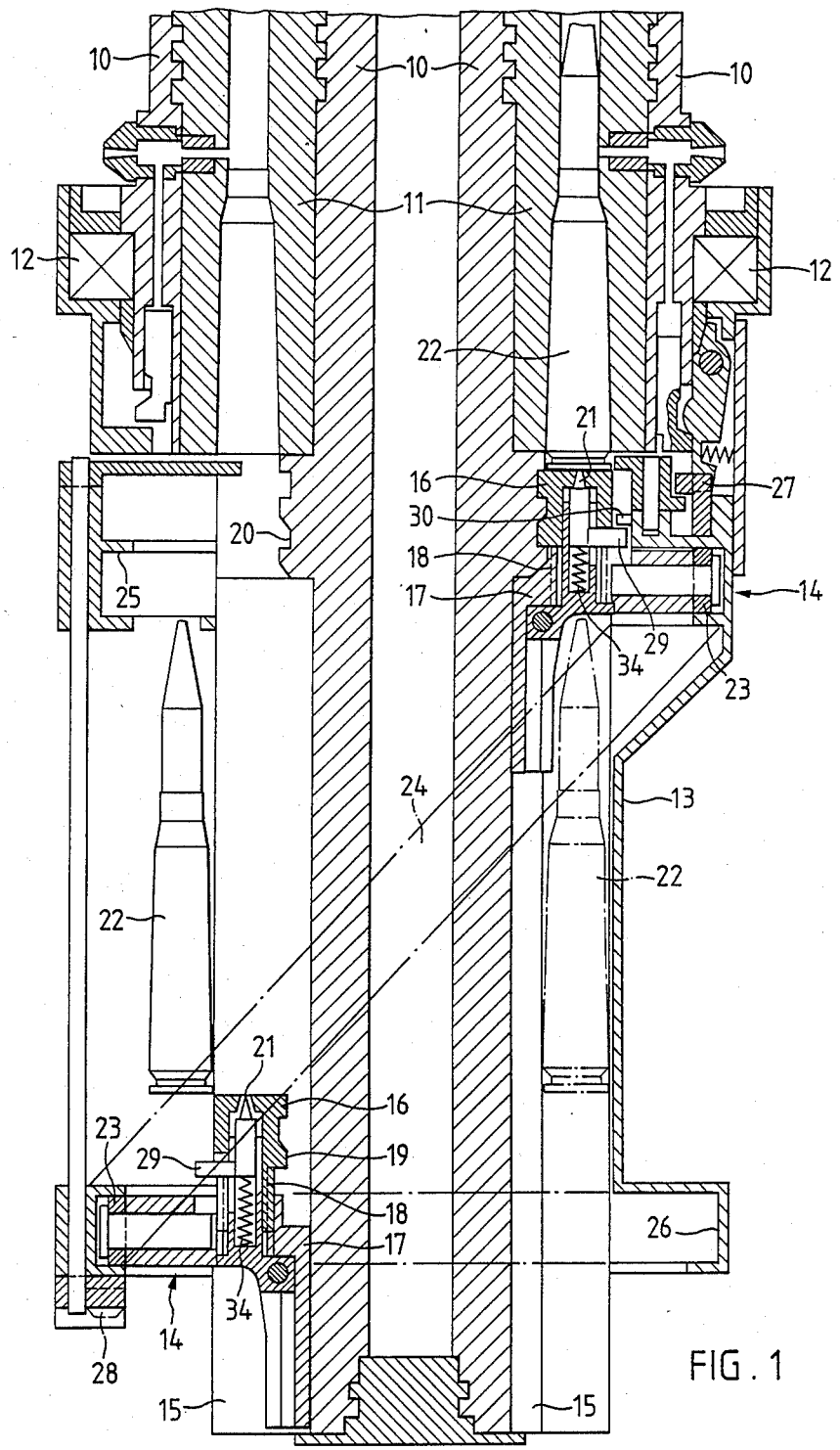
FIG. 1 shows a longitudinal section through a multi-barrel firing weapon containing an exemplary embodiment of the inventive firing apparatus.

Describing now the drawings, it is to be understood that to simplify the showing thereof only enough of the structure of the firing apparatus and the related firing weapon has been illustrated therein as is needed to enable one skilled in the art to readily understand the underlying principles and concepts of this invention. Turning now specifically to FIG. 1 of the drawings, there is illustrated therein by way of example and not limitation a firing weapon containing six weapon barrels 11 which are removably fixed in a rotor 10 in a manner which is know as such. Only two of these six weapon barrels 11 are depicted in FIG. 1. The rotor 10 is rotatably mounted in a weapon housing 13 by means of a bearing 12. A respective breechblock 14 is associated with each weapon barrel 11. Each breechblock 14 is displaceably mounted at longitudinal guides or guide members 15 in the rotor 10. In FIG. 1, two breechblocks 14 are depicted. One breechblock 14 is situated in its forwardmost and locked position and the other breechblock 14 is located in its rearmost and unlocked position.

Each breechblock 14 possesses a breechblock head 16 and a breechblock head carrier or support 17. The breechblock head 16 and the breechblock head carrier or support 17 together form a rotary breechblock which is known as such and in which the breechblock head 16 is connected with the breechblock head carrier or support 17 by means of a steep pitch screw thread 18. Locking cams or dogs 19 of the breechblock head 16 engage recesses 20 in the rotor 10 when the breechblock 14 is locked in its forwardmost position.

Furthermore, the breechblock 14 possesses a spring-loaded ignition or firing pin 21 which can pierce or penetrate a cartridge 22 located in the related weapon barrel 11 in the forwardmost locked position of the breechblock 14. An operating lever or cocking pin 29 is fixed to the ignition or firing pin 21 and cooperates with a control cam 30 shown in FIGS. 2 to 6. This control cam 30 releases the firing pin 21 for piercing or penetrating the cartridge 22 at the correct moment of time. A spring 34 has the tendency to thrust the ignition or firing pin 21 against the base of the cartridge 22 so as to pierce and thus fire the cartridge 22. The spring 34 is supported at the breechblock head carrier or support 17 and at the ignition or firing pin 21.

The breechblock 14 further possesses a cam follower roll 23 which engages a first control cam 24 in the weapon housing 13. This first control cam 24 has the effect of reciprocating the individual breechblocks 14 during rotation of the rotor 10 in the weapon housing 13. The first control cam 24 is substantially elliptically constructed on the inside of the substantially cylindrical weapon housing 13. At a front end and at a rear end of the weapon housing 13 there are further respectively provided second and third control cams 25 and 26 which are substantially circularly constructed on the inside of the weapon housing 13.

There is no displacement of the breechblock 14 during rotation of the rotor 10 in the weapon housing 13, when the cam follower roll 23 of the breechblock 14 engages either one of the second and third control cams 25 and 26. The breechblock 14 stays in the forwardmost position when the cam follower roll 23 is situated in the second control cam 25. The breechblock 14 stays in the rearmost position when the cam follower roll 23 is situated in the substantially circular third control cam 26. Deflecting or switching elements 27 and 28 are provided, so that the cam follower roll 23 is enabled to move out from the elliptical first control cam 24 into a related one of the second and third control cams 25 and 26.

The firing weapon described with reference to FIG. 1 is assumed to be known and therefore here described only insofar as necessary for understanding the invention. The invention will now be explained in detail with reference to FIGS. 2 to 6.

Figure 2:
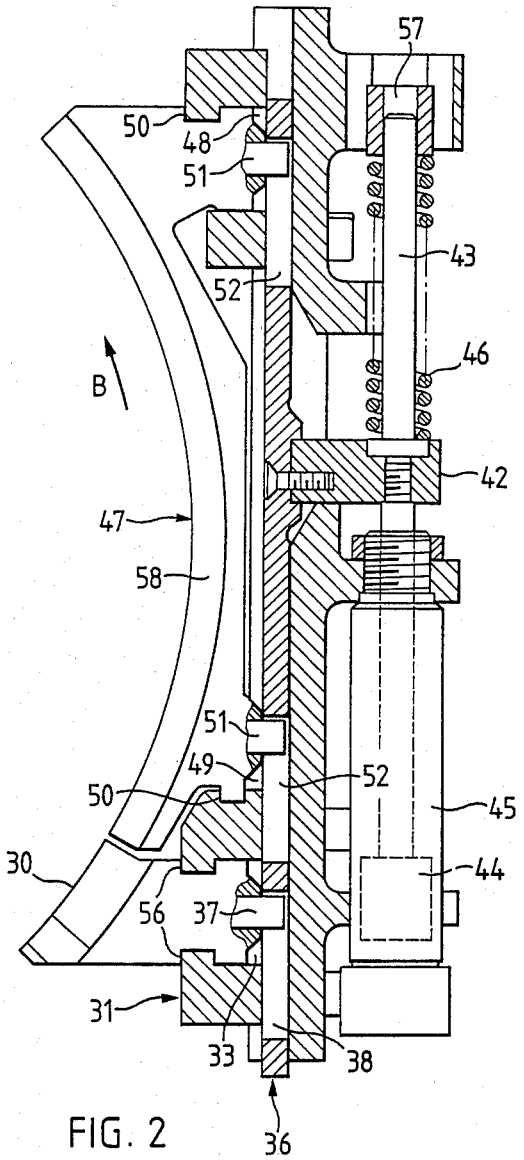
FIG. 2 is a side view of the inventive firing apparatus.
Figure 5:
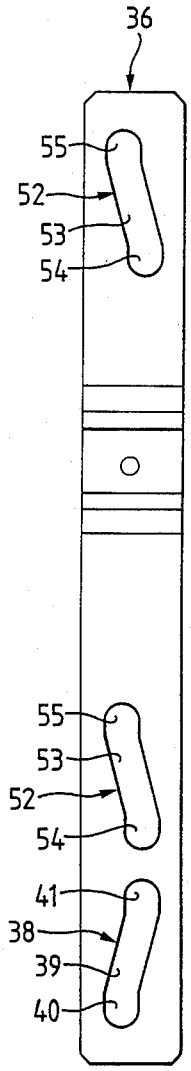
FIG. 5 is a plan view of the control slide of the firing apparatus shown in FIG. 2.
Figure 6:
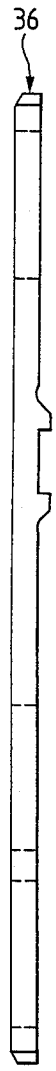
FIG. 6 is a side view of the control slide depicted in FIG. 5.
Figure 3:
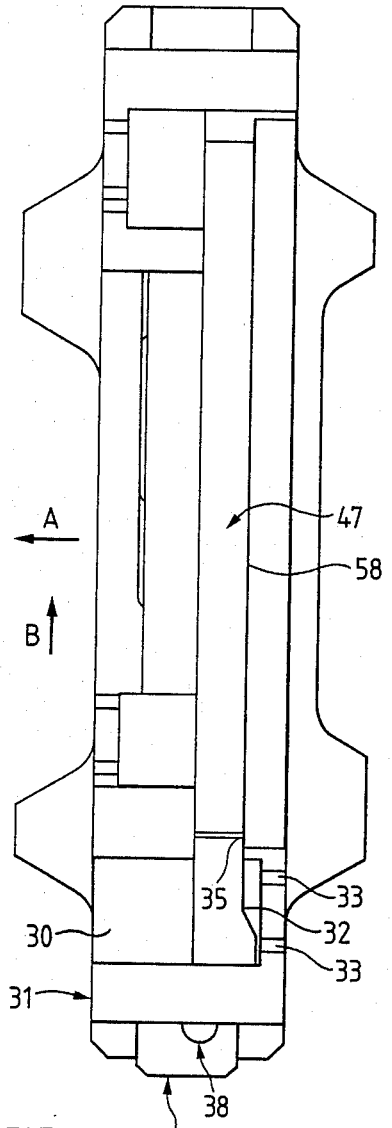
FIG. 3 is a top plan view of the firing apparatus shown in FIG. 2 in its unarmed or safety position.
Figure 4:
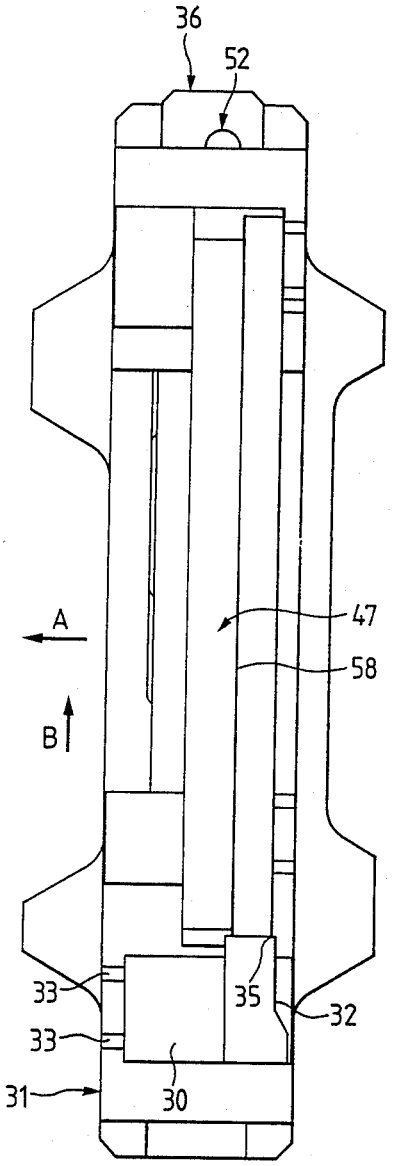
FIG. 4 is a top plan view of the firing apparatus shown in FIG. 2 and in its firing position.

In accordance with FIGS. 2 to 4, a displaceable control cam 30 is displaceably held on a plate 31. This plate 31 is fixed at the weapon housing 13, see FIG. 1, in a here not particularly shown manner. For clarity in understanding the firing direction of the firing weapon is indicated by an arrow A in FIGS. 3 and 4. The point or tip of the ignition or firing pin 21 depicted in FIG. 1 also points in this firing direction A. The operating lever or cocking pin 29 of the firing pin 21 is supported at a control surface 32 of the displaceable control cam 30. A guide groove 33 is provided in the plate 31 for guiding the displaceable control cam 30 at the plate 31. In accordance with FIG. 2 the guide groove 33 possesses two rails 56 which engage related grooves formed in the displaceable control cam 30 and thereby prevent this displaceable control cam 30 from falling out of the guide groove 33.

The displaceable control cam 30 is positioned in its forwardmost position as illustrated in FIG. 3, and in this position the spring 34 loading the ignition or firing pin 21 is only slightly tensioned when the operating lever or cocking pin 29 is supported at the control surface 32 of the displaceable control cam 30. The displaceable control cam 30 is located in its rearmost position as illustrated in FIG. 4, i.e. the spring loading the ignition or firing pin 21 is tensioned and enables the ignition or firing pin 21 to pierce or penetrate the cartridge 22 as soon as the operating or cocking pin 29 slides off from the control surface 32 of the displaceable control cam 30 over an edge 35 thereof. The operating lever or cocking pin 29 slides at the control surface 32 of the displaceable control cam 30 in the direction of the arrow B.

Displacing means 36, 44, 46 contain a slide 36 for displacing the displaceable control cam 30 out of its forwardmost or unarmed or safety position shown in FIG. 3 into its rearmost or firing position as shown in FIG. 4. This control slide 36 is shown in FIGS. 2 and 3 in its lower end position; in FIG. 4 the control slide 36 is shown in its top end position. The control slide 36 is finally completely illustrated in FIGS. 5 and 6.

The displaceable control cam 30 possesses a guide bolt or pin 37 which engages a control groove or slot 38 of the control slide 36. The shape of this control groove or slot 38 can be seen in FIG. 5. The control groove or slot 38 comprises three sections, namely a central section 39 which is inclined at an angle relative to the direction of extent of the control slide 36, and two substantially straight sections or portions 40 and 41 at related ends of the control groove or slot 38 and substantially extending in the direction of extent of the control slide 36, see FIG. 5. When the guide bolt or pin 37 is situated in the straight section 41 at the inner end of the control groove or slot 38, then the displaceable control cam 30 assumes its forwardmost position shown in FIG. 3 and consequently the firing weapon is unarmed or safe due to the fact that the spring 34 loading the ignition or firing pin 21 cannot be tensioned. When the guide bolt or pin 37 is positioned in the straight section 40 at the outer end of the control groove or slot 38, then the displaceable control cam 30 assumes its rearmost position shown in FIG. 4 and the firing weapon is armed or cocked due to the fact that the spring 34 loading the ignition or firing pin 21 is tensioned as soon as the operating lever or cocking pin 29 moves onto the control surface 32 of the displaceable control cam 30.

An entrainment member 42 is fixed to the control slide 36 for its operation and is also fixed at a piston rod 43. A piston 44 located in a cylinder 45 is fixed to this piston rod 43 and forms part of the displacement or displacing means 36, 44, 46. A spring 46 also constitutes part of the displacement means 36, 44, 46 and urges the control slide 36 and the piston 44 into their lowermost position which is shown in FIG. 2 and in which the firing weapon therefore is rendered unarmed or safe. The spring 46 is supported with one end at the entrainment member 42 and with its other end at a guide member 57 of the plate 31. The piston 44 can be displaced against the force of the spring 46 by means of a source of hydraulic oil and thereby also the control slide 36 arrives at its armed or cocked position.

As noted hereinbefore, the spring 34 loading the ignition or firing pin 21 is not tensioned in the armed or cocked position of the displaceable control cam 30, see FIG. 3. When the operating lever or cocking pin 29 thus slides off the control surface 32 of the displaceable control cam 30 across the edge 35, then the ignition or firing pin 21 cannot pierce or penetrate the cartridge 22 but merely contacts such cartridge. If this should be prevented, preferably a further displaceable control cam 47 is provided for the operating lever or cocking pin 29. This further displaceable control cam 47 is displaceably held at both its ends at the plate 31 exactly like the displaceable control cam 30. Two guide grooves 48 and 49 are provided in the plate 31 for guiding the further displaceable control cam 47 at the plate 31. These guide grooves 48 and 49 possess two guide rails 50, see FIG. 2, which engage related grooves in the further displaceable control cam 47 and thereby prevent such control cam 47 from falling out of the guide grooves 48 and 49.

As illustrated in FIG. 3, the further displaceable control cam 47, in contrast to the displaceable control cam 30, is situated in its rearmost position and prevents the ignition or firing pin 21 from piercing or penetrating the cartridge 22. In this arrangement a cam surface 58 of the further displaceable control cam 47 is positioned in the same plane as the control surface 32 of the displaceable control cam 30. As illustrated in FIG. 4 the further displaceable control cam 47, in contrast to the displaceable control cam 30, is positioned in its forwardmost position and in this position permits the cartridge 22 to be pierced.

The control slide 36, which has already been described hereinbefore, serves for displacing the further displaceable control cam 47 from its rearmost position shown in FIG. 3 into its forwardmost position shown in FIG. 4. The further displaceable control cam 47 possesses two guide bolts or pins 51 which engage two associated control grooves or slots 52 formed in the control slide 36. The shape of these two control grooves or slots 52 is evident from FIG. 5. Each of these two control grooves or slots 52 comprises three sections or portions, namely a central section 53 which is inclined at an angle relative to the direction of extent of the control slide 36, and two substantially straight sections 54 and 55 at related ends of the control grooves or slots 52 and substantially extending in the direction of extent of the control slide 36, see also FIG. 5. The central inclined sections 53 of the control grooves or guide slots 52 extend in an opposite direction to the central inclined section 39 of the control groove or slot 38, i.e. extend opposite to the direction of inclination of such inclined section 39. This has the result that during operation of the control slide 36 the two displaceable control cams 30 and 47 are displaced in opposite directions, i.e. in opposing travel directions as will be readily recognized from the FIGS. 3 and 4.

The mode of operation of the firing apparatus described hereinbefore is as follows:

For delivering continuous or series fire, the rotor 10 is driven by a motor and this rotor 10 thus begins to rotate conjointly with the weapon barrels 11 in the bearings 12 of the weapon housing 13. Due to this rotation of the rotor 10, the breechblock 14 moves from its rearmost position into its forwardmost position due to the fact that the cam follower roll 23 is guided in the elliptical control cam 24 of the weapon housing 13. During this operation the cartridge 22 is inserted into the related weapon barrel 11 in known manner and the breechblock head 16 is locked at the rear of the weapon barrel 11. During further rotation of the rotor 10 the breechblock 14 is unlocked again and returned into its starting position by means of the elliptical control cam 24.

Shortly before the breechblock 14 reaches its forwardmost position the operating lever or cocking pin 29 impinges against the displaceable control cam 30. As a result, the operating lever or cocking pin 29 can no longer forwardly move together with the breechblock 14. Consequently, the spring 34 is compressed and the ignition or firing pin 21 is rearwardly displaced relative to the bottom or base of the cartridge 22. Due to the fact that the operating lever or cocking pin 29 rotates conjointly with the rotor 10 relative to the weapon housing 13, whereas the displaceable control cam 30, which is fixed to the weapon housing 13, cannot rotate, the operating lever or cocking pin 29 will slide off over the edge 35 at the end of the control surface 32 of the displaceable control cam 30, whereby the cartridge 22 will be pierced or penetrated.

The piercing or penetration of the cartridge 22 by the ignition or firing pin 21 is prevented when the displaceable control cam 30 is situated in its unarmed or safe position shown in FIG. 3. In the unpressurized condition of the hydraulic cylinder 45 the spring 46 insures that the displaceable control cams 30 and 47 are situated in their unarmed or safe positions shown in FIG. 3.

In order that the continuous or series fire may have the correct firing rate beginning with the first shot, the rotor 10 is first accelerated until assuming the desired rotational speed. Thereafter, the piston 44 is displaced in the cylinder 45 against the force of the spring 46. Simultaneously therewith the control slide 36 is also displaced and the two displaceable control cams 30 and 47 are displaced in opposing directions from the unarmed or safe position shown in FIG. 3 into the cocked or firing position shown in FIG. 4. As a result of such displacements of the two displaceable control cams 30 and 47 the ignition or firing pin 21 and thus the operating lever or cocking pin 29 can now be cocked against the force of the spring 34. As soon as the operating lever or cocking pin 29 reaches the cam edge or edge 35, the cartridge 22 will be pierced or penetrated.

While there are shown and described present preferred embodiments of the invention, it is to be distinctly understood that the invention is not limited thereto, but may be otherwise variously embodied and practiced within the scope of the following claims.

Accordingly, what I claim is:

1. A firing apparatus for firing a cartridge in an externally powered firing weapon containing at least one revolving weapon barrel, comprising:

a reciprocatable breechblock operatively associated with said at least one revolving weapon barrel;

means for positively reciprocating said breechblock relative to said at least one revolving weapon barrel;

a spring-loaded firing pin displaceably mounted in said breechblock;

two displaceable control cams for cocking and releasing said firing pin in order to pierce said cartridge;

displacing means for displacing said two displaceable control cams from an unarmed position into a firing position;

said displacing means containing a control slide provided with two control grooves extending in opposite directions;

a spring operatively connected to said control slide and urging said control slide into an unarmed position of said control slide; and said displacing means containing hydraulic piston means acting upon said control slide in order to displace said control slide into a firing position of said control slide and against the force of said spring.

2. A firing apparatus for firing a cartridge in an externally powered firing weapon containing at least one revolving weapon barrel, comprising:

a reciprocatable breechblock operatively associated with said at least one revolving weapon barrel;

means for positively reciprocating said breechblock relative to said at least one revolving weapon barrel;

a spring-loaded firing pin displaceably mounted in said breechblock;

two displaceable control cams for cocking and releasing said firing pin in order to pierce said cartridge;

displacing means for displacing said two displaceable control cams from an unarmed position into a firing position;

said displacing means containing a control slide provided with two control grooves extending in opposite directions;

said control slide extending in a predetermined direction;

each one of said two control grooves containing a central section which is inclined relative to said predetermined direction of extent of said control slide; and each one of said two control grooves further containing substantially straight sections at related ends of said control groove and extending substantially in said predetermined direction of extent of said control slide.

3. The firing apparatus as defined in claim 2, wherein:

said central sections of said two control grooves are oppositely inclined relative to each other and with respect to said predetermined direction of extent of said control slide.

* * * * *